US011048197B1

(12) United States Patent
Onishi

(10) Patent No.: US 11,048,197 B1
(45) Date of Patent: Jun. 29, 2021

(54) IMAGE FORMING APPARATUS WITH TONER SENSOR AND NOTIFICATION METHOD FOR SAME

(71) Applicant: TOSHIBA TEC KABUSHIKI KAISHA, Tokyo (JP)

(72) Inventor: Kei Onishi, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/810,791

(22) Filed: Mar. 5, 2020

(51) Int. Cl.
*G03G 15/00* (2006.01)
*G03G 15/08* (2006.01)

(52) U.S. Cl.
CPC ..... *G03G 15/5025* (2013.01); *G03G 15/0849* (2013.01); *G03G 15/0851* (2013.01); *G03G 15/0853* (2013.01); *G03G 15/0855* (2013.01); *G03G 15/0865* (2013.01); *G03G 15/5041* (2013.01); *G03G 15/55* (2013.01); *G03G 15/553* (2013.01); *G03G 15/556* (2013.01); *G03G 15/0889* (2013.01)

(58) Field of Classification Search
CPC ..... G03G 15/0889; G03G 15/5025; G03G 15/55; G03G 15/553; G03G 15/556; G03G 15/0849; G03G 15/0851; G03G 15/0853; G03G 15/0855; G03G 15/0865; G03G 15/5041
See application file for complete search history.

(56) References Cited

U.S. PATENT DOCUMENTS

2005/0063715 A1* 3/2005 Suzuki ..... G03G 15/0822 399/27

FOREIGN PATENT DOCUMENTS

JP 2008-052057 A 3/2008

* cited by examiner

*Primary Examiner* — Joseph S Wong
(74) *Attorney, Agent, or Firm* — Foley & Lardner LLP

(57) ABSTRACT

An image forming apparatus includes a developer container, an agitator, a toner supply, a toner sensor, and a controller. The developer container contains a two-component developer that includes toner and carrier. The agitator stirs the two-component developer. The toner supply replenishes the developer container with additional toner. The toner sensor detects a toner density of the two-component developer in the developer container. The controller calibrates the toner sensor using the two-component developer. The controller compares a first detection value indicating a toner density at a first time with a second detection value indicating a toner density at a second time after a predetermined time period has elapsed since the first time. The controller issues a notification regarding a suitability of calibration based on a comparison result of the first detection value and the second detection value.

16 Claims, 8 Drawing Sheets

IMAGE FORMING APPARATUS WITH TONER SENSOR AND NOTIFICATION METHOD FOR SAME

FIELD

Embodiments described herein relate generally to an image forming apparatus and a notification method.

BACKGROUND

In the related art, for example, a two-component developer including toner and carrier is used for an image forming apparatus. When the image forming apparatus using the two-component developer is delivered to a customer, a toner density sensor provided in a developing device is calibrated. In order to perform calibration, the toner density of the two-component developer needs to be appropriately maintained. For example, when the developer is inserted into the developing device, the developer is stirred to be uniform, and the toner density sensor is calibrated. In this calibration, a control input voltage of the toner density sensor is adjusted so that an output value of the toner density sensor becomes a target value.

Here, during the stirring operation of the developer, a predetermined bias is applied to a photosensitive drum so that the toner in the developing device is not transferred onto the photosensitive drum.

However, when transporting the image forming apparatus, if a wiring defect due to looseness of the connector, condensation occurring during the process leading up to delivery, or the like occurs, there may be a problem where the predetermined bias cannot be successfully applied to the photosensitive drum during the stirring operation. When such a problem occurs, the toner in the developing device is transferred onto the photosensitive drum during the stirring operation, and calibration is performed in a state where the toner density is not appropriate. Therefore, an appropriate toner density cannot be maintained, and the image quality may be deteriorated.

DETAILED DESCRIPTION

In general, according to one embodiment, an image forming apparatus includes a storage unit, a stirring unit, a replenishment unit, a detection unit, a calibration unit, a comparison unit, and a notification unit. The storage unit contains a two-component developer including toner and carrier. The stirring unit stirs the two-component developer. The replenishment unit replenishes the storage unit with toner. The detection unit detects a toner density of the two-component developer in the storage unit. The calibration unit calibrates the detection unit using the two-component developer where the stirring is performed. The comparison unit compares a first detection value indicating a toner density at a first timing with a second detection value indicating a toner density at a second timing after a predetermined time period elapsed since the first timing. The notification unit issues a notification regarding the suitability of calibration based on a comparison result of the comparison unit.

Figure 1:
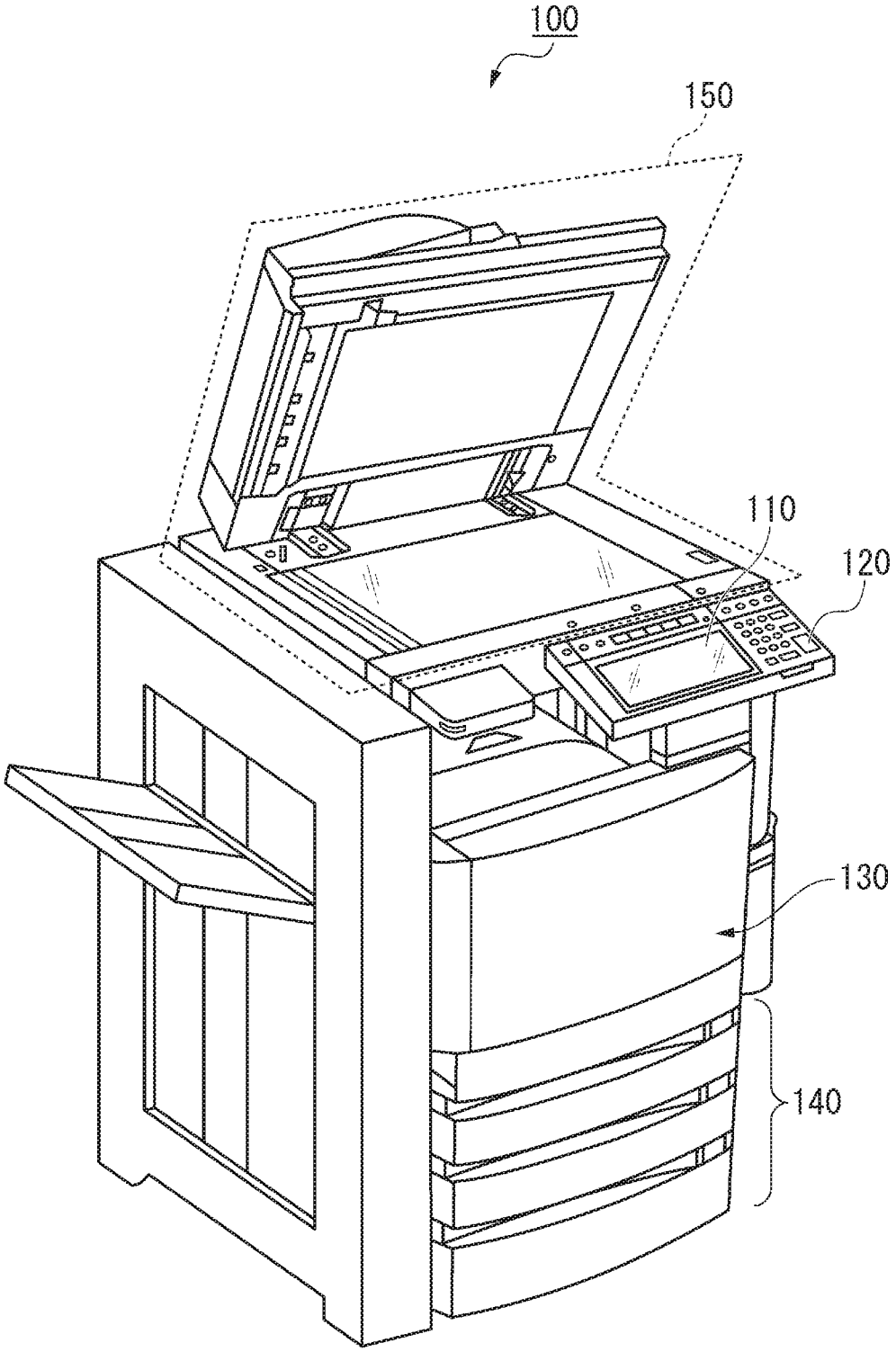
FIG. 1 is a perspective view illustrating an overall configuration example of an image forming apparatus according to an embodiment.

FIG. 1 is a perspective view illustrating an overall configuration example of an image forming apparatus 100 according to an embodiment. The image forming apparatus 100 is, for example, a multifunction peripheral. The image forming apparatus 100 includes a display 110, a control panel 120, a printer 130, a sheet storage unit 140, and an image reading unit (image reader) 150.

The display 110 is, for example, a liquid crystal display with a touch panel. The display 110 displays various information. The display 110 receives an operation from a user. The display 110 displays various operation screens, the image status, operation circumstances of various functions, and the like according to a display control signal output from a control unit 400 (see FIG. 4).

The control panel 120 includes various operation keys such as a numeric keypad and a start key. The control panel 120 receives various input operations from the user. The control panel 120 outputs operation signals corresponding to various input operations received from the user to the control unit.

The printer 130 performs a series of printing operations using various information output from the display 110, the control panel 120, the image reading unit 150, and the like. The series of printing operations includes an operation of inputting image information, an operation of forming an image, an operation of transferring the formed image to a sheet, and an operation of conveying the sheet.

The sheet storage unit 140 includes a plurality of sheet cassettes. Each sheet cassette accommodates sheets.

The image reading unit 150 includes an automatic document feeder and a scanner device. The automatic document feeder sends out a document placed on a document tray to the scanner device. The scanner device optically scans a document on a document glass table, and forms an image of light reflected from the document on a light receiving surface of a charge coupled device (CCD) sensor. As a result, the scanner device reads the document image on the document glass table. The image reading unit 150 generates image information (e.g., image data) using the reading result read by the scanner device.

Figure 2:
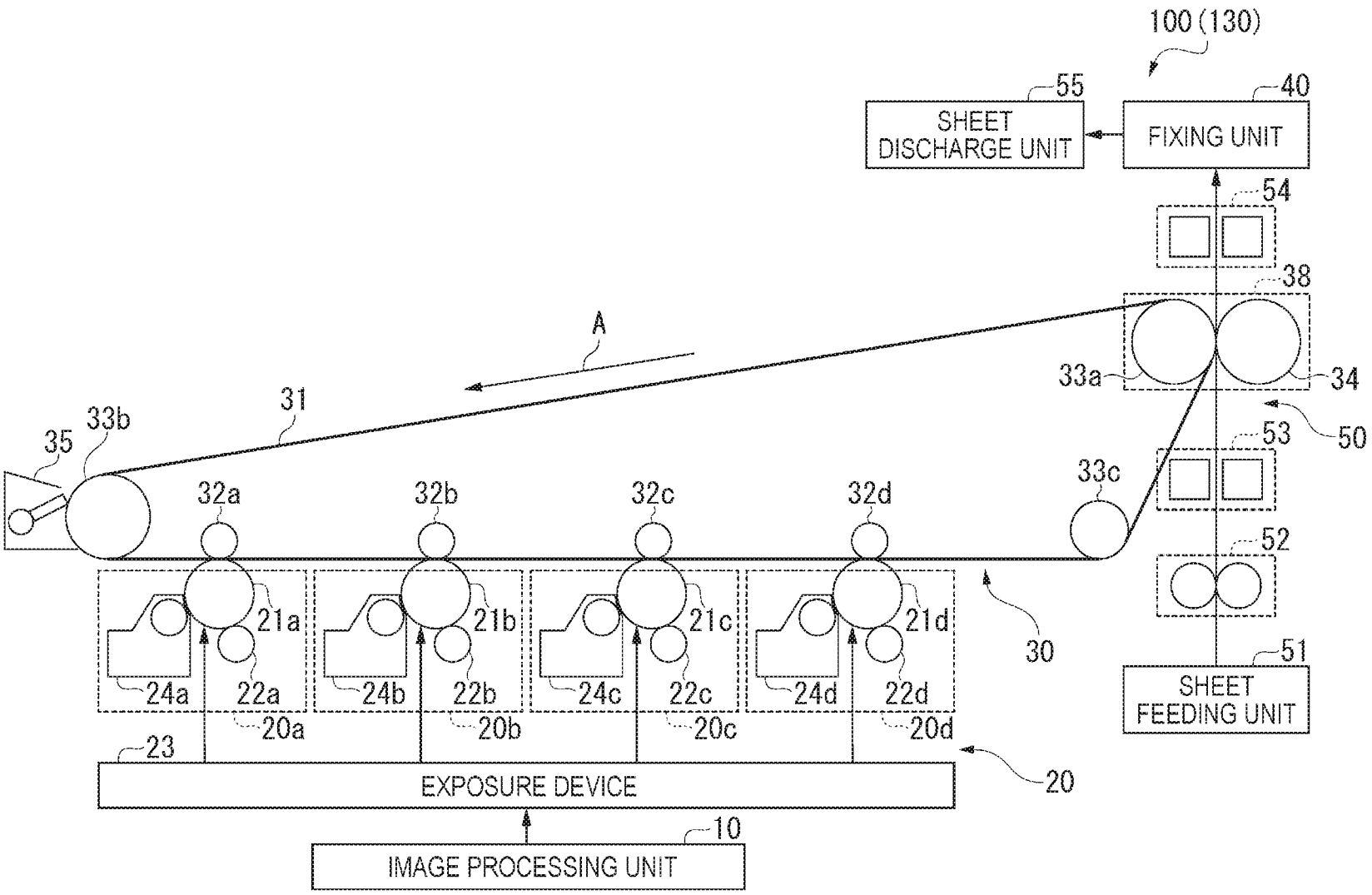
FIG. 2 is a diagram illustrating an example of an internal configuration of the image forming apparatus of FIG. 1.

FIG. 2 is a diagram illustrating an example of an internal configuration of the image forming apparatus 100. As illustrated in FIG. 2, the image forming apparatus 100 (specifically, the printer 130) includes four image forming units 20*a* to 20*d* in parallel. The image forming apparatus 100 is a so-called quadruple tandem type image forming apparatus. The image forming apparatus 100 includes an image processing unit 10, an image forming unit 20 (20*a* to 20*d*), an intermediate transfer unit 30, a fixing unit 40, a sheet conveying unit 50, an alignment sensor, and an image density sensor.

The image processing unit 10 inputs image information. The image information to be input may include image information generated by the image reading unit 150 or image information transmitted from another device. The image processing unit 10 performs digital image processing that processes the input image information according to initial settings or user settings. For example, digital image processing includes gradation correction based on gradation correction data. In addition to gradation correction, digital image processing includes various correction processing such as color correction and shading correction, and compression processing on image data.

Next, the image forming unit 20 (e.g., including image forming units 20*a* to 20*d*) will be described. The image forming unit 20 includes an image forming unit 20*a* corresponding to yellow (Y), an image forming unit 20*b* corresponding to magenta (M), an image forming unit 20*c* corresponding to cyan (C), and an image forming unit 20*d* corresponding to black K. The respective image forming units 20*a* to 20*d* include respective photosensitive drums 21*a* to 21*d*, respective chargers 22*a* to 22*d*, an exposure device 23, respective developing devices 24*a* to 24*d*, a drum cleaning device 25 (see FIG. 3), and the like. In the following, the description will be made with the symbols a to d omitted.

The photosensitive drum 21 is, for example, a charged organic photoconductor (OPC) in which an undercoat layer, a charge generation layer, and a charge transport layer are sequentially laminated on the peripheral surface of an aluminum conductive cylinder. The photosensitive drum 21 has photoconductivity.

A charger 22 generates corona discharge. The charger 22 uniformly charges the surface of the photosensitive drum 21.

The exposure device 23 is, for example, a semiconductor laser. The exposure device 23 irradiates the photosensitive drum 21 with laser light corresponding to the image of each color component. If the laser light is irradiated by the exposure device 23, the potential of the region irradiated with the laser light in the region of the surface of the photosensitive drum 21 changes. Due to this potential change (e.g., a potential difference), an electrostatic latent image is formed on the surface of the photosensitive drum 21.

The developing device 24 contains the developer. The developing device 24 attaches toner of each color component to the surface of the photosensitive drum 21. Thus, a toner image is formed on the photosensitive drum 21. That is, the electrostatic latent image formed on the surface of the photosensitive drum 21 is visualized.

Here, the developer will be described. For example, a two-component developer is used as the developer. The two-component developer contains non-magnetic toner and carrier. For the carrier, for example, iron powder having a particle size of several tens of μm or polymer ferrite particles are used. The carrier is mixed with the toner in the developing device 24 and is tribo-electrically charged to give the toner a charge (for example, a negative charge). Further, the carrier conveys the toner to the electrostatic latent image portion by a magnetic force. However, the developer is not limited to a two-component developer, and a one-component developer that does not use a carrier can also be used.

The drum cleaning device 25 (see FIG. 3) includes a cleaning blade in contact with the surface of the photosensitive drum 21. The cleaning blade removes residual toner remaining on the surface of the photosensitive drum 21 after the primary transfer. The removed residual toner is collected in a storage unit included in the drum cleaning device.

Next, the intermediate transfer unit 30 will be described. The intermediate transfer unit 30 includes an intermediate transfer body 31, a primary transfer roller 32, a plurality of support rollers 33, a secondary transfer roller 34, a belt cleaning device 35, and the like.

The intermediate transfer body 31 is, for example, an endless belt (transfer belt). The intermediate transfer body 31 has conductivity and elasticity.

Support rollers 33*a* to 33*c* support the intermediate transfer body 31 so that tension is applied to the intermediate transfer body 31. Thus, the intermediate transfer body 31 is formed in a continuous loop shape. One of the plurality of support rollers 33*a* to 33*c* (for example, the support roller 33*c*) is a driving roller. Rollers other than the driving roller are driven rollers. As the driving roller rotates, the intermediate transfer body 31 travels in the A direction at a predetermined speed and with a predetermined cycle.

Here, the direction in which the intermediate transfer body 31 moves can be defined as an upstream direction and a downstream direction. Specifically, the direction in which the intermediate transfer body 31 moves can be defined with the image forming unit 20*a* as the most upstream and the belt cleaning device 35 as the most downstream.

The primary transfer roller 32 is disposed to face the photosensitive drum 21 via the intermediate transfer body 31. Specifically, the primary transfer roller 32 is disposed so that pressure is applied to the photosensitive drum 21 with the intermediate transfer body 31 interposed therebetween. As a result, a primary transfer portion that nips the intermediate transfer body 31 is formed by the primary transfer roller 32 and the photosensitive drum 21.

When the intermediate transfer body 31 passes through the primary transfer portion, the toner image formed on the photosensitive drum 21 is transferred onto the intermediate transfer body 31. When the intermediate transfer body 31 passes through the primary transfer portion, a primary transfer bias is applied to the primary transfer roller 32. Specifically, for example, a charge having an opposite polarity (e.g., a positive polarity) to that of the toner is applied to the primary transfer roller 32. As a result, the toner image formed on the photosensitive drum 21 is electrostatically transferred to the intermediate transfer body 31.

The secondary transfer roller 34 is disposed to face the support roller 33*a* through the intermediate transfer body 31. Specifically, the secondary transfer roller 34 is disposed so that pressure is applied to the support roller 33*a* with the intermediate transfer body 31 interposed therebetween.

As a result, the secondary transfer unit 38 that nips the intermediate transfer body 31 and the sheet is formed by the secondary transfer roller 34 and the support roller 33*a*.

When the sheet passes through the secondary transfer unit 38, the toner image on the intermediate transfer body 31 is transferred onto the sheet. When the sheet passes through the secondary transfer unit 38, a secondary transfer bias is applied to the support roller 33*a*. Specifically, a charge having the same polarity (e.g., a negative polarity) as that of the toner is applied to the support roller 33*a*.

As a result, the toner image on the intermediate transfer body 31 is electrostatically transferred to the sheet. The secondary transfer roller 34 and the support roller 33*a* can be separated from each other. Thus, when a sheet is jammed in the secondary transfer unit 38, the user can remove the sheet.

The belt cleaning device 35 includes a cleaning blade that contacts the surface of the intermediate transfer body 31. The cleaning blade removes residual toner remaining on the surface of the intermediate transfer body 31 after the secondary transfer. The removed residual toner is collected in a storage unit included in the belt cleaning device 35.

The fixing unit 40 heats and pressurizes the sheet on which the toner image is transferred. As a result, the fixing unit 40 fixes the toner image on the sheet. The fixing unit 40 may be a system in which a toner image is fixed on a sheet by heating the sheet through a film-like member.

Next, the sheet conveying unit 50 will be described. The sheet conveying unit 50 includes a sheet feeding unit 51, a registration unit 52, a first guide unit 53, a second guide unit 54, and a sheet discharge unit 55.

The sheet feeding unit 51 conveys the sheets accommodated in the sheet storage unit 140 one by one to the registration unit 52. The registration unit 52 stops the sheet conveyed from the sheet feeding unit 51 and sends out the sheet to the secondary transfer unit 38 at a predetermined timing. The predetermined timing is a timing at which the toner image formed on the intermediate transfer body 31 is secondarily transferred.

The first guide unit 53 regulates the conveyance direction of the sheet sent out from the registration unit 52. Further, the first guide unit 53 sends out the sheet whose conveyance direction is regulated to the secondary transfer unit 38.

The secondary transfer unit 38 transfers the toner image to the sheet whose conveyance direction is regulated by the first guide unit 53. Further, the secondary transfer unit 38 sends out the sheet on which the toner image is transferred to the fixing unit 40.

The second guide unit 54 regulates the conveyance direction of the sheet sent out from the secondary transfer unit 38. The fixing unit 40 heats and pressurizes the sheet whose conveyance direction is regulated by the second guide unit 54, and sends out the sheet to the sheet discharge unit 55. The sheet discharge unit 55 sends out the sheet to the discharge tray.

Figure 3:
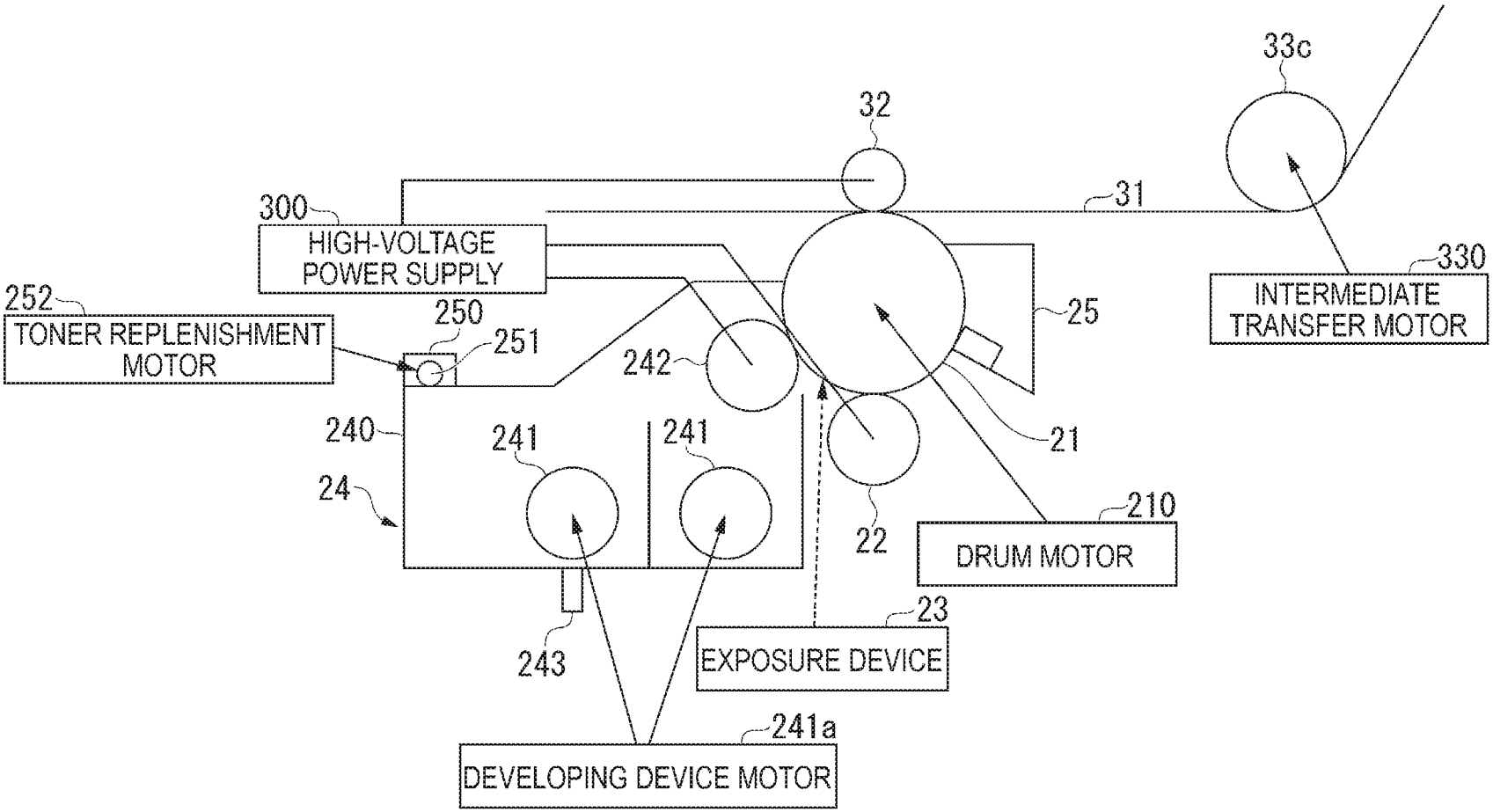
FIG. 3 is a diagram illustrating an example of a configuration around a developing device of the image forming apparatus of FIG. 1.

FIG. 3 is a diagram illustrating an example of a configuration around the developing device 24. As illustrated in FIG. 3, the developing device 24 includes a developer storage unit 240, stirring rollers 241, a developing roller 242, and a toner density sensor 243.

The developer storage unit 240 (i.e., a developer container) contains a two-component developer. The developer storage unit 240 is an example of a storage unit or container (e.g., a bucket, a box, a tray, an enclosure, etc.). The stirring roller 241 is provided at the bottom of the developer storage unit 240. The stirring roller 241 includes a developing device motor 241*a*. The stirring roller 241 stirs the two-component developer by the driving force of the developing device motor 241*a*. Thus, the toner and the carrier of the two-component developer become uniform. The toner is charged. The stirring roller 241 is an example of a stirring unit or agitator.

The developing roller 242 is a cylindrical rotating roller. A part of the developing roller 242 is exposed from the opening of the developer storage unit 240. The exposed portion is disposed to face the photosensitive drum 21. The developing roller 242 carries the two-component developer contained in the developer storage unit 240 and conveys the two-component developer to a portion facing the photosensitive drum 21. The photosensitive drum 21 is connected to a drum motor 210 and rotates in the opposite direction to the developing roller 242. Further, the developing roller 242 is driven to rotate while being in contact with the photosensitive drum 21 in a state of holding the toner.

A predetermined bias (for example, negative voltage) is applied to the developing roller 242 by a high-voltage power supply 300. A predetermined bias (for example, positive voltage) is applied to the charger 22. The charger 22 charges the surface of the photosensitive drum 21. Due to the bias applied by the high-voltage power supply 300, a potential difference is generated between the surface of the developing roller 242 and the surface of the photosensitive drum 21, and the toner negatively charged on the developing roller 242 is transferred onto the photosensitive drum 21. In this way, the developing roller 242 causes the toner to adhere to the electrostatic latent image formed on the photosensitive drum 21 to form a toner image. That is, the developing roller 242 develops the electrostatic latent image.

Further, the moving speed of the surface of the photosensitive drum 21 is equal to the moving speed of the sheet, that is, the processing speed in the image forming apparatus 100. Further, the support roller 33*c* of the intermediate transfer body 31 is a driving roller of the intermediate transfer body 31. The support roller 33*c* is rotated by the driving force of an intermediate transfer motor 330 so that the moving speed of the surface of the photosensitive drum 21 and the moving speed of the intermediate transfer body 31 are the same.

The developing device 24 can be replenished with toner from a toner replenishment unit 250. The toner replenishment unit 250 includes a toner replenishment roller 251. The toner replenishment roller 251 is provided between a toner replenishment port of a toner cartridge (not illustrated) and a toner replenishment port of the developer storage unit 240. The toner replenishment roller 251 is rotated by the driving force of a toner replenishment motor 252 and causes the developer storage unit 240 to be replenished with toner. The toner replenishment unit 250 is an example of a replenishment unit or toner supply.

The toner density sensor 243 is a sensor that detects the toner density in the developer storage unit 240. The toner density sensor 243 is provided at the bottom of the developer storage unit 240. The toner density sensor 243 outputs a sensor output (e.g., an output voltage) corresponding to the control input voltage and the toner density in the developer storage unit 240. The toner density sensor 243 outputs a sensor output corresponding to the magnetic permeability (e.g., a toner density) by detecting the magnetic permeability having a correlation with the toner density. The toner density sensor 243 is an example of a detection unit.

Figure 4:
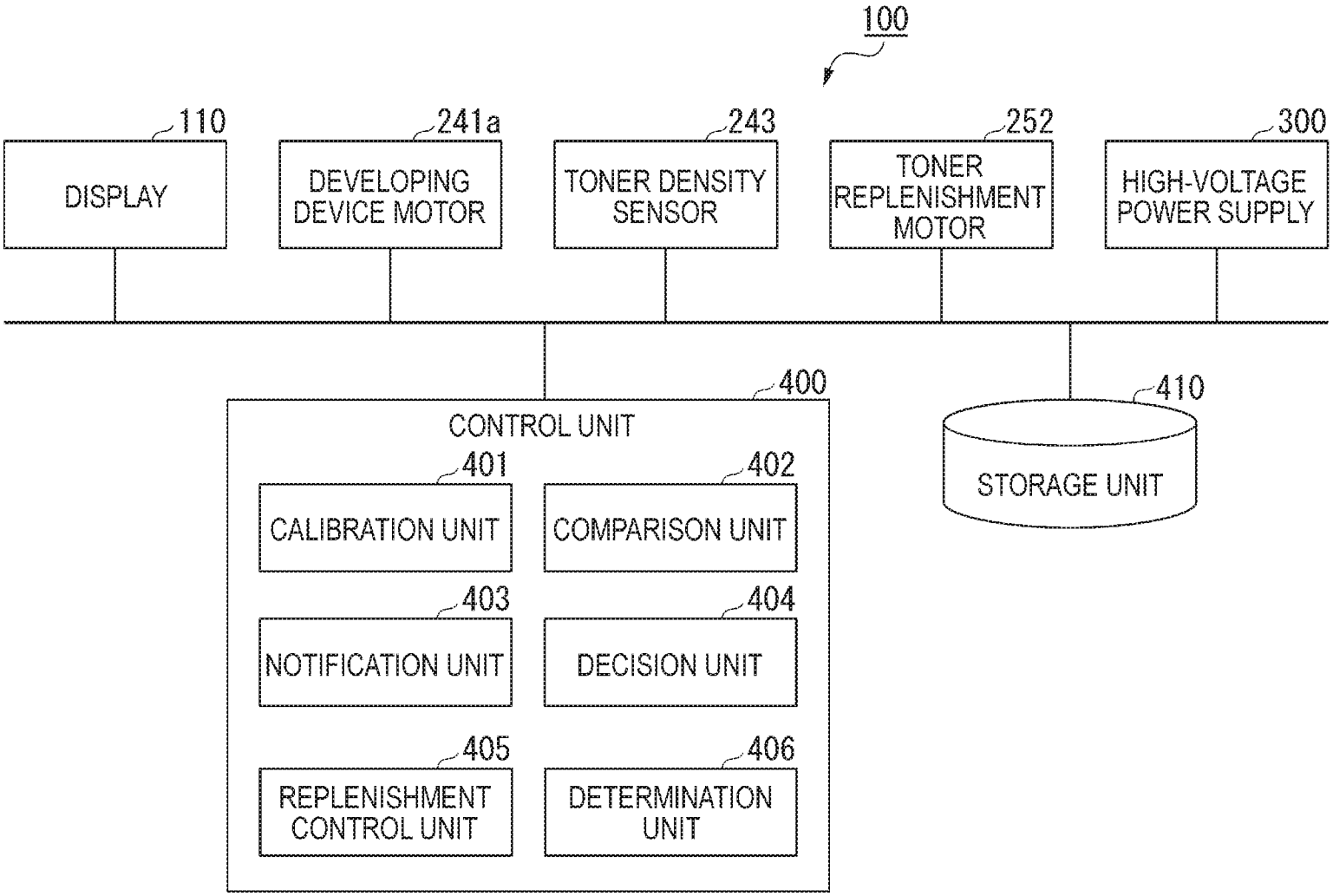
FIG. 4 is a block diagram illustrating a functional configuration related to developer stirring processing of the image forming apparatus of FIG. 1.

FIG. 4 is a block diagram illustrating a functional configuration related to the developer stirring processing of the image forming apparatus 100 according to the embodiment. In FIG. 4, the image forming apparatus 100 includes the display 110, the developing device motor 241*a*, the toner density sensor 243, the toner replenishment motor 252, the high-voltage power supply 300, the controller or control unit 400, and the storage unit 410. The control unit 400 includes a calibration unit 401, a comparison unit 402, a notification unit 403, a decision unit 404, a replenishment control unit 405, and a determination unit 406.

The control unit 400 is realized by a processor such as a CPU. The control unit 400 functions as the calibration unit 401, the comparison unit 402, the notification unit 403, the decision unit 404, the replenishment control unit 405, and the determination unit 406 by executing a program using the processor. The storage unit 410 is realized by a storage device such as a magnetic hard disk device or a semiconductor storage device.

When the image forming apparatus 100 is shipped and delivered to a customer (i.e., a delivery is completed), a stirring operation and a calibration operation of the toner density sensor 243 are performed according to the operation of an operator such as a service person. In the stirring operation, the control unit 400 controls the toner replenishment motor 252 to replenish toner into the developer storage unit 240. The control unit 400 controls the developing device motor 241*a* to stir the developer in the developer storage unit 240. As a result, the toner in the developer storage unit 240 is negatively charged.

The control unit 400 controls the high-voltage power supply 300 to apply a bias (for example, −600 V) to the photosensitive drum 21 (charger 22) during the calibration operation. The control unit 400 controls the high-voltage power supply 300 to apply a bias (for example, −500 V) to the developing roller 242 during the calibration operation. Thereby, it is possible to prevent the toner (e.g., having a negative polarity) from being transferred to the photosensitive drum 21 during the calibration operation.

The calibration unit 401 calibrates the toner density sensor 243 using the two-component developer in which the toner is replenished into the storage unit and stirring is performed. The calibration is an operation of adjusting the control input voltage of the toner density sensor 243 so that the output value of the toner density sensor 243 becomes a target value (e.g., is within a target value range). The calibration unit 401 uses the output value of the toner density sensor 243 to adjust the control input voltage so that the toner density becomes 6 to 10 weight percent (wt %), for example. Here, the toner density can be expressed by a ratio of the toner weight to the toner and carrier weight. That is, the toner density can be expressed as "toner density"="toner weight/(toner weight+carrier weight)".

The toner density can be increased as the volume of the developer storage unit 240 increases. For this reason, the toner density is a value that varies depending on the model. In this embodiment, as an example, the control input voltage is adjusted so that the toner density becomes about 8 wt %. Further, when the toner density is 8 wt %, the control input voltage is adjusted so that the output value of the toner density sensor 243 becomes, for example, 2.5 V.

Here, when transporting the image forming apparatus 100, if a wiring defect due to looseness of the connector, condensation during the process leading up to the delivery, or the like occurs, there may be a problem that a −600 V bias cannot be applied to the photosensitive drum 21 during the stirring operation, and the voltage applied to the photosensitive drum 21 becomes, for example, 0 V. When such a problem occurs, the toner in the developer storage unit 240 is transferred onto the photosensitive drum 21 during the stirring operation, and calibration is performed in a state where the toner density is not appropriate.

Therefore, the image forming apparatus 100 according to the present embodiment issues a notification regarding the suitability of calibration based on the comparison result between a first detection value indicating the toner density at a first timing (e.g., a first point in time relative to a reference, such as the beginning of time measurement, a first time, etc.) and a second detection value indicating the toner density at a second timing (e.g., a second point in time relative to a reference, such as the beginning of time measurement, a second time, etc.) after a predetermined time elapsed since the first timing. Specifically, the image forming apparatus 100 issues a notification regarding the suitability of calibration based on the comparison result between the first detection value of the toner density when the first time elapsed and the second detection value of the toner density when the second time elapsed since the start of the developer stirring. A detailed description will be made below.

The control unit 400 starts the measurement of time when toner is replenished into the developer storage unit 240 and stirring is started. The comparison unit 402 compares the first detection value indicating the toner density at the first timing with the second detection value indicating the toner density at the second timing.

The first timing is, for example, a timing at which a first time (e.g., a first time period) has elapsed since the start of developer stirring. More specifically, the first timing is a timing at which the first time period has elapsed since the control unit 400 starts the measurement of time. The first time period is, for example, 60 seconds. However, the first timing is not limited to the timing triggered by the developer stirring, and may be the timing triggered by another operation.

The second timing is a timing at which a first predetermined time period (for example, 60 seconds) has elapsed since the first timing. Specifically, the second timing is, for example, a timing at which a second time period has elapsed since the control unit 400 starts the measurement of time, where the second timing elapses after the first time has elapsed. The second time period is, for example, 120 seconds. Both the first detection value and the second detection value are represented by the output value (V) of the toner density sensor 243. In the following description, the detection value of the toner density and the output value of the toner density sensor 243 will be described as having the same meaning unless specifically distinguished.

For example, the comparison unit 402 compares the output value (e.g., a first detection value) of the toner density sensor 243 when 60 seconds have elapsed from the start of the measurement of time and the output value (e.g., a second detection value) of the toner density sensor 243 when 120 seconds have elapsed from the start of the measurement of time.

More specifically, the comparison by the comparison unit 402 is a comparison as to whether or not the comparison value obtained by comparing the first detection value and the second detection value is equal to or greater than a threshold value. This comparison value is a value based on the difference between the first detection value and the second detection value, for example. The value based on the difference is, for example, an absolute value of a difference between the first detection value and the second detection value, in other words, a value indicating an increase or a decrease between the first detection value and the second detection value. The threshold value is a value that can determine that the toner density is abnormal. The storage unit 410 stores the first detection value, the second detection value, and the threshold value. The comparison unit 402 refers to each value stored in the storage unit 410 when performing the comparison.

Here, for example, an example of a threshold value for determining that the toner density is abnormal when the toner density changes by ±1 wt % or more will be described. For example, in the image forming apparatus 100, it is assumed that the output value of the toner density sensor 243 is set to change by 0.25 V when the toner density changes by 1 wt %. In this case, when the toner density is set to ±1 wt % as a threshold value, the threshold value becomes ±0.25 V when converted to the output value of the toner density sensor 243.

More specifically, for example, in the image forming apparatus 100, when the toner density is 8 wt %, it is assumed that the output value of the toner density sensor 243 is set to, for example, 2.5 V. For example, if the output value of the toner density sensor 243 is 2.75 V, the fact indicates that the toner density is 7 wt %. For example, if the output value of the toner density sensor 243 is 2.25 V, the fact indicates that the toner density is 9 wt %. Therefore, if the output value of the toner density sensor 243 is within the range of 2.25 V to 2.75 V (e.g., if the absolute value of the difference between the first detection value and the second detection value is less than the threshold value), the toner density can be determined to be normal. On the other hand, if the output value of the toner density sensor 243 is not within the range of 2.25 V to 2.75 V (e.g., if the absolute value of the difference between the first detection value and the second detection value is equal to or greater than the threshold value), the toner density can be determined to be abnormal. The toner density, the output value, and the threshold value described here are merely examples, and can be set to different values according to the specifications or the like of the image forming apparatus 100.

Further, the comparison value is not limited to a value based on the difference between the first detection value and the second detection value. For example, the comparison value may be a value based on the ratio between the first detection value and the second detection value. The value based on the ratio is, for example, the ratio of the second detection value to the first detection value or the ratio of the first detection value to the second detection value.

The notification unit 403 issues a notification regarding the suitability of calibration based on the comparison result by the comparison unit 402. The notification regarding the suitability of calibration is, for example, a notification regarding that calibration is appropriate or notification regarding that calibration is not appropriate. Specifically, the notification regarding that calibration is appropriate is, for example, a notification that the calibration is performed appropriately, a notification that the toner density is appropriate, and a notification that printing is possible. In addition, the notification regarding that calibration is not appropriate is, for example, a notification that the calibration is inappropriate, a notification that the toner density is not appropriate, a notification that printing is not possible, or a notification prompting the developer to be replaced.

The notification unit 403 issues a notification regarding that the calibration is appropriate when a comparison result in which the comparison value is less than the threshold value is obtained. In addition, the notification unit 403 issues a notification regarding that the calibration is not appropriate when a comparison result in which the comparison value is equal to or greater than the threshold value is obtained.

The notification unit 403 controls the display 110 to issue a notification regarding the suitability of calibration. The notification regarding the suitability of calibration is not limited to the notification by displaying of the display 110. The notification regarding the suitability of calibration may be a voice notification in addition to or instead of the display notification.

The decision unit 404 determines whether the toner density decreased or increased during stirring when a comparison result in which the comparison value is equal to or greater than the threshold value is obtained. During the stirring operation, for example, when the toner is transferred onto the photosensitive drum 21 and the amount of toner in the developer storage unit 240 decreases, the magnetic permeability increases. Thus, when the amount of toner in the developer storage unit 240 decreases, that is, when the toner density decreases, the output value of the toner density sensor 243 increases. Accordingly, the decision unit 404 can determine that the toner density decreases when the output value of the toner density sensor 243 increases.

In addition, during the stirring operation, for example, when the carrier is transferred onto the photosensitive drum 21 and the amount of the carrier in the developer storage unit 240 decreases, the magnetic permeability decreases. For this reason, when the amount of the carrier in the developer storage unit 240 decreases, that is, when the toner density increases, the output value of the toner density sensor 243 decreases. Accordingly, the decision unit 404 can determine that the toner density increases when the output value of the toner density sensor 243 decreases.

The notification unit 403 issues different notifications depending on when the decision unit 404 determines that the toner density decreases and that the toner density increases during stirring. For example, when it is determined that the toner density decreased, the notification unit 403 issues a notification regarding that the toner decreased during the stirring operation, that the toner was transferred onto the photosensitive drum 21, and the like. In addition, if it is determined that the toner density increased, the notification unit 403 issues a notification regarding that the carrier decreased during the stirring operation, that the carrier was transferred onto the photosensitive drum 21, and the like.

The replenishment control unit 405 causes the toner replenishment unit 250 to replenish toner. Specifically, the replenishment control unit 405 drives the toner replenishment motor 252 to replenish toner. For example, the replenishment control unit 405 drives the toner replenishment motor 252 to replenish toner when the decision unit 404 determines that the toner density decreased during stirring.

The amount of toner to be replenished is, for example, an amount corresponding to a magnitude of the decrease in the toner density. The amount corresponding to the magnitude of the decrease in the toner density can be obtained from the output value of the toner density sensor 243. For example, the storage unit 410 stores a table in which the value increased by the toner density sensor 243 is associated with the amount of toner to be replenished. The replenishment control unit 405 refers to the table stored in the storage unit 410 and can obtain the amount of toner to be replenished from the value increased by the toner density sensor 243.

When the toner is replenished by the replenishment control unit 405, the control unit 400 drives the developing device motor 241*a* again, stirs the developer, and starts the measurement of time. Further, the comparison unit 402 compares the first detection value with the second detection value again when the toner is replenished by the replenishment control unit 405.

The determination unit 406 determines whether or not printing is possible based on the comparison result by the comparison unit 402. For example, the determination unit 406 determines that printing is not possible when a comparison result in which the comparison value is equal to or greater than the threshold value is obtained in the second comparison. In response to a determination that printing is not possible, the control unit 400 may prevent printing.

However, the determination unit 406 may determine that printing is not possible when a comparison result in which the comparison value is equal to or greater than the threshold value is obtained in the first comparison. Specifically, when the decision unit 404 determines that the toner density decreased during stirring, the toner replenishment by the replenishment control unit 405 or the second comparison by the comparison unit 402 may not be performed. In this case, the determination unit 406 may determine that printing is not possible when a comparison result in which the comparison value is equal to or greater than the threshold value is obtained in the first comparison.

Further, the determination unit 406 determines that printing is possible when a comparison result in which the comparison value is less than the threshold value is obtained.

Specifically, the determination unit 406 determines that printing is possible when a comparison result in which the comparison value is less than the threshold value is obtained in the second comparison. When a comparison result in which the comparison value is less than the threshold value is obtained in the second comparison, the determination unit 406 may determine that printing is possible by setting an upper limit number of prints and a printable period because the comparison result in which the comparison value is equal to or greater than the threshold value in the first comparison is obtained (an abnormality is detected).

Further, when a comparison result in which the comparison value is less than the threshold value is obtained in the second comparison, the control unit 400 may cause the comparison unit 402 to perform the comparison again without replenishing the toner, as a precaution. Then, the determination unit 406 may determine that printing is possible when a comparison result in which the comparison value is less than the threshold value is obtained in this comparison. Thereby, the accuracy of the determination indicating whether or not the calibration is performed appropriately can be improved.

Further, when a comparison result in which the comparison value is less than the threshold value is obtained in the second comparison, the notification unit 403 issues a notification regarding that printing is possible because the printing is temporarily possible. However, since the comparison result in which the comparison value is equal to or greater than the threshold value is obtained in the first comparison, that is, an abnormality occurred in the first stirring operation, the notification unit 403 issues a notification regarding that the comparison result in which the comparison value is equal to or greater than the threshold value was obtained in the first comparison. This notification is, for example, a notification that prompts the developer to be replaced as a precaution, although printing is possible. Further, the notification unit 403 may prompt the developer to be replaced by displaying a predetermined icon or mark on the display 110 until the developer is replaced.

In addition, when the notification unit 403 issues a notification regarding that the calibration is not appropriate, the control unit 400 may control a communication unit (e.g., a communication interface or bus) to transmit a developer order, the fact that a problem occurred during the developer stirring operation, and information indicating that the calibration was not normally performed to a predetermined service center or the like.

Further, the determination unit 406 determines that printing is not possible when the decision unit 404 determines that the toner density increased during stirring. That is, during the stirring operation, for example, when the carrier is transferred onto the photosensitive drum 21 and an abnormality occurs in which the amount of the carrier in the developer storage unit 240 is reduced, the carrier cannot be replenished and thus, the determination unit 406 immediately determines that printing is not possible.

Figure 5:
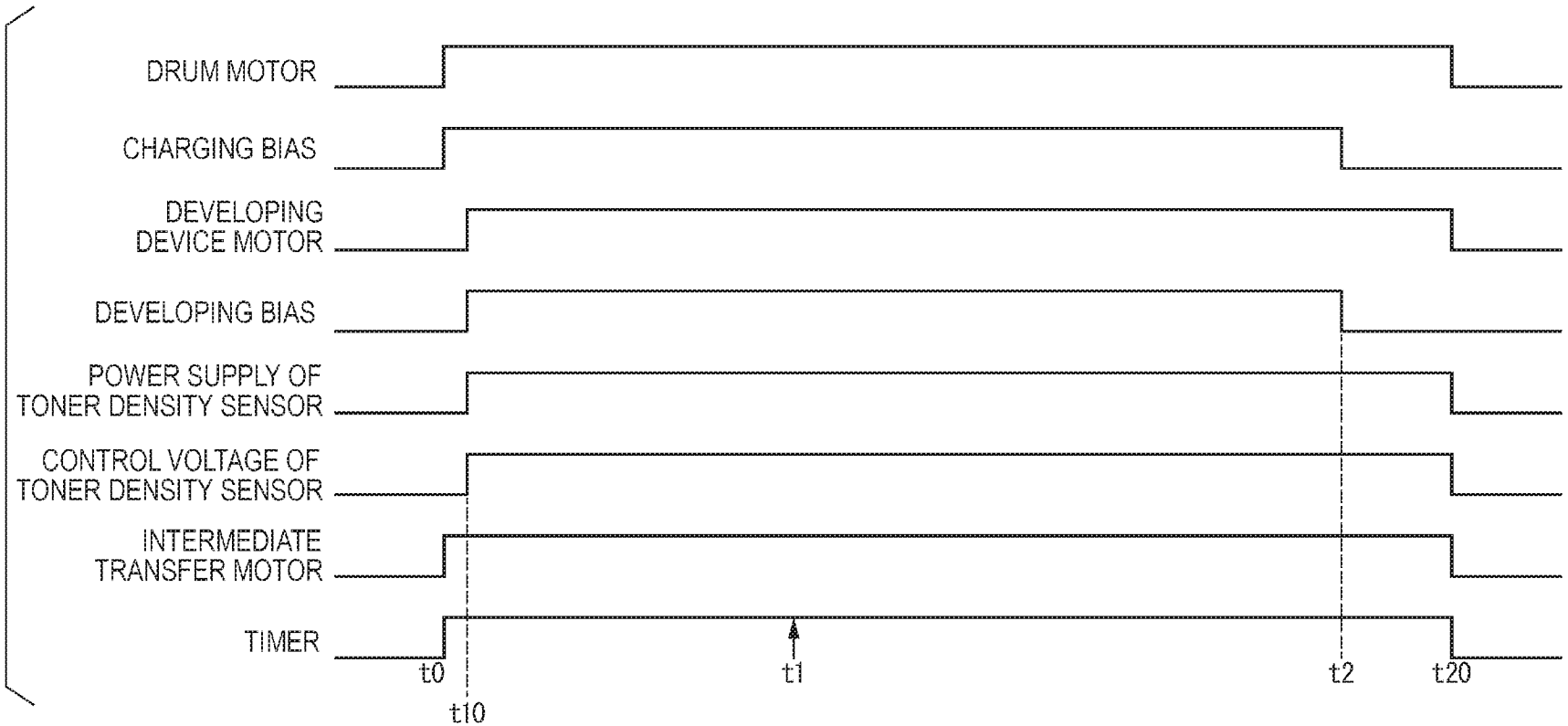
FIG. 5 is a graph illustrating an example of a timing chart of each unit when a toner density sensor is calibrated.

FIG. 5 is an explanatory diagram illustrating an example of a timing chart of each unit when the toner density sensor 243 is calibrated. As illustrated in FIG. 5, a timing t0 is a timing at which calibration is started. At the timing t0, the drum motor 210 is driven and the photosensitive drum 21 rotates. Further, when a predetermined bias (for example, a voltage of −600 V) is applied to the charger 22, the surface of the photosensitive drum 21 is charged. At the timing t0, the intermediate transfer motor 330 is also driven, and the intermediate transfer body 31 also travels. Furthermore, at the timing t0, the timer starts the measurement of time.

At a timing t10, the developing device motor 241*a* is driven, and the stirring roller 241 rotates. Further, at the timing t10, a developing bias (for example, −500 V) is applied to the developing roller 242. At the timing t10, the power of the toner density sensor 243 is turned on. Further, at the timing t10, the control input voltage (e.g., the control voltage) of the toner density sensor 243 is also turned on, and the control input voltage is adjusted.

At a timing t1 (for example, 60 seconds), the comparison unit 402 acquires the output value (i.e., a first detection value) of the toner density sensor 243 and stores the acquired output value in the storage unit 410. Further, at a timing t2 (for example, 120 seconds), the comparison unit 402 acquires the output value (i.e., a second detection value) of the toner density sensor 243, and compares the comparison value obtained by comparing the output value at the timing t1 with the output value at the timing t2, with the threshold value stored in the storage unit 410.

At the timing t2, the charging bias and the developing bias are turned off. Further, at a timing t20, the drum motor 210, the developing device motor 241*a*, the toner density sensor 243, the control voltage of the toner density sensor 243, the intermediate transfer motor 330, and the timer are turned off. Thus, the stirring operation of the developer and the calibration operation of the toner density sensor 243 are completed.

If the toner density decreases during the stirring operation, the toner is replenished and the stirring operation and the calibration operation similar to the above are performed again.

Figure 6:
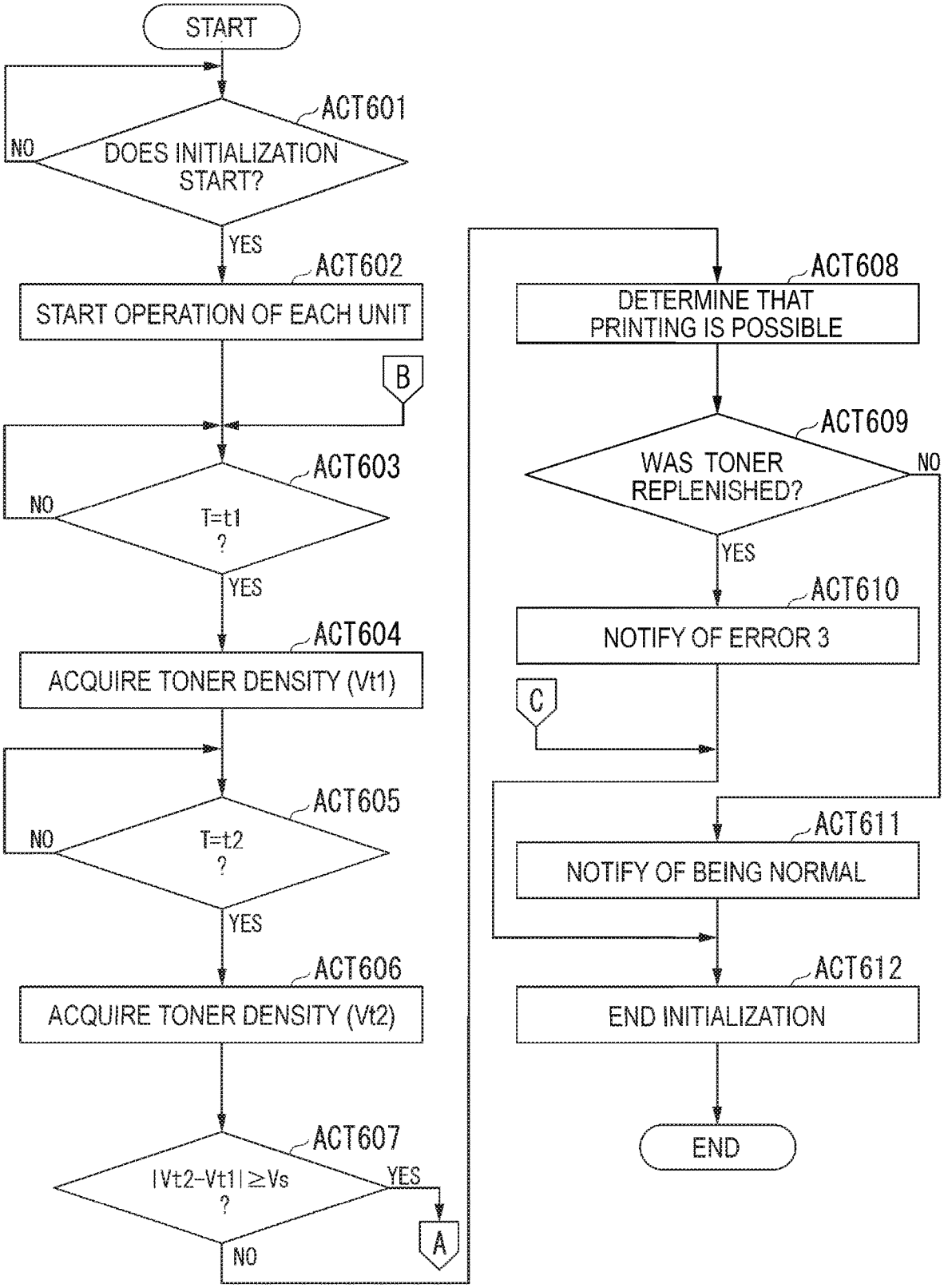
FIG. 6 is a flowchart illustrating an example of calibration processing performed by the image forming apparatus.
Figure 7:
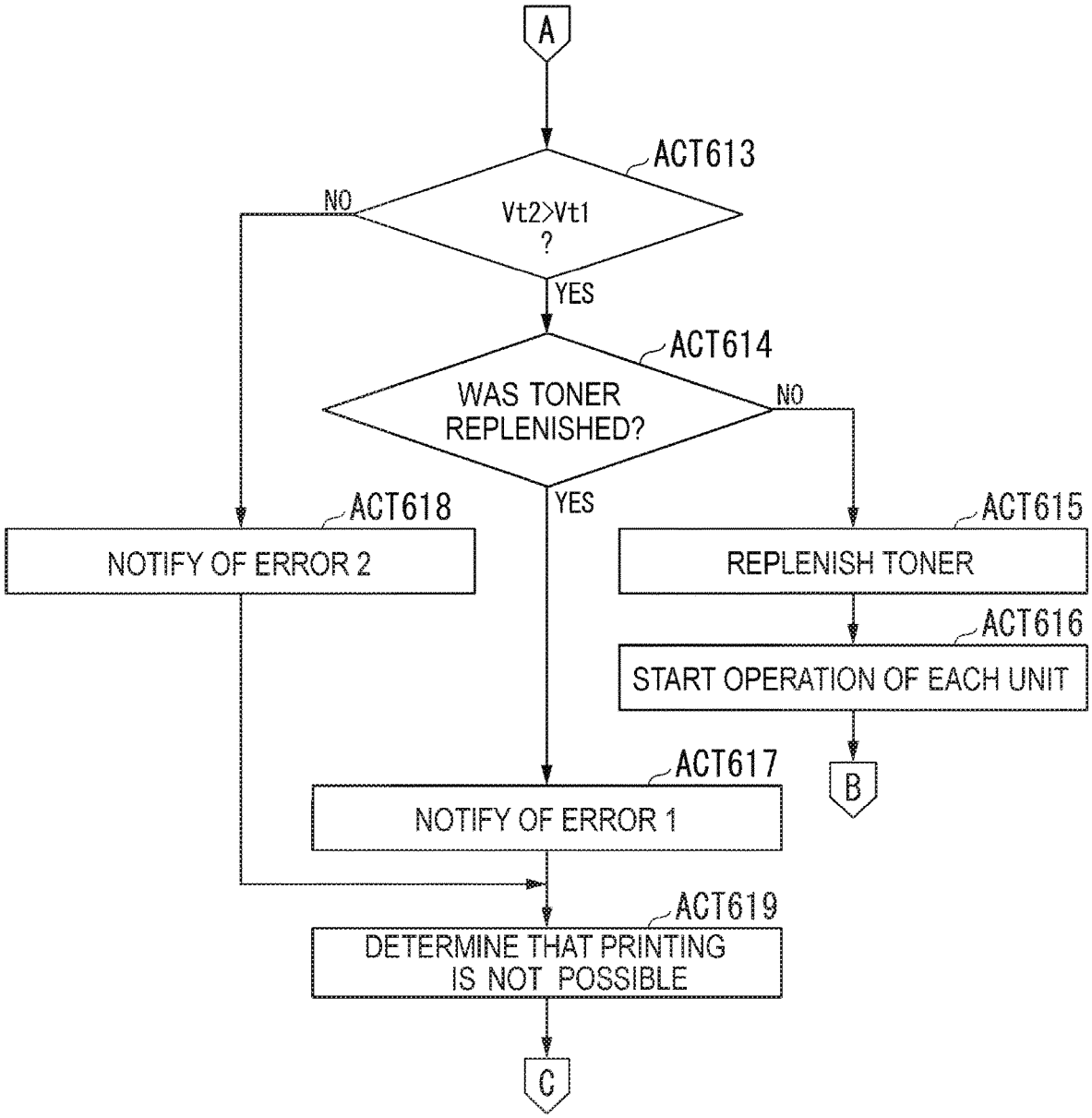
FIG. 7 is a flowchart illustrating another portion of the calibration processing of FIG. 6.

FIGS. 6 and 7 are flowcharts illustrating examples of calibration processing performed by the image forming apparatus 100. As illustrated in FIG. 6, the control unit 400 determines whether or not the start timing of the initialization (e.g., the stirring operation and the calibration operation) of the toner density sensor 243 is reached (ACT 601). This start timing is a timing at which an initial setting start operation such as a calibration operation is received from an operator such as a service person.

The control unit 400 waits until the initialization start timing is reached (ACT 601: NO). If the initialization start timing is reached (ACT 601: YES), the control unit 400 starts the operation of each unit illustrated in FIG. 5 (ACT 602). In ACT 602, for example, the operation of each unit is started at the timing t0 and the timing t10 illustrated in FIG. 5. Thereby, for example, the stirring operation and the calibration operation are started.

Then, the comparison unit 402 determines whether or not a measured value T of the timer is reached the timing t1 (e.g., 60 seconds) (ACT 603). The comparison unit 402 waits until the measured value T of the timer reaches the timing t1 (ACT 603: NO). If the measured value T of the timer reaches the timing t1 (ACT 603: YES), the comparison unit 402 acquires an output value Vt1 (i.e., the first detection value) of the toner density sensor 243 (ACT 604).

Then, the comparison unit 402 determines whether or not the measured value T of the timer is reached the timing t2 (e.g., 120 seconds) (ACT 605). The comparison unit 402 waits until the measured value T of the timer reaches the timing t2 (ACT 605: NO). If the measured value T of the timer reaches the timing t2 (ACT 605: YES), the comparison unit 402 acquires an output value Vt2 (i.e., the second detection value) of the toner density sensor 243 (ACT 606).

Then, the comparison unit 402 determines whether or not the comparison value |Vt2−Vt1| that is the difference between the output value Vt1 and the output value Vt2 is equal to or greater than a threshold value Vs (ACT 607). If the comparison value |Vt2 −Vt1| is less than the threshold value Vs (ACT 607: NO), the determination unit 406 determines that printing is possible (ACT 608). Then, the replenishment control unit 405 determines whether or not the toner was replenished (ACT 609). If the toner was replenished (ACT 609: YES), that is, if the comparison in ACT 607 is the second comparison, the notification unit 403 controls the display 110 to issue a notification regarding calibration error 3 (see FIG. 8C) (ACT 610).

In ACT 609, if the toner was not replenished (ACT 609: NO), that is, if the comparison in ACT 607 is the first comparison, the notification unit 403 controls the display 110 to issue a notification regarding that the calibration is normally completed (see FIG. 8D) (ACT 611). Then, the control unit 400 ends the initialization of the toner density sensor 243 (ACT 612) and ends a series of processes.

In ACT 607, if the comparison value |Vt2 −Vt1| is equal to or greater than the threshold value Vs (ACT 607: YES), as illustrated in FIG. 7, the decision unit 404 determines whether or not the output value Vt2 is greater than the output value Vt1 (ACT 613). If the output value Vt2 is greater than the output value Vt1 (ACT 613: YES), that is, for example, if the toner in the developer storage unit 240 is transferred onto the photosensitive drum 21 and the magnetic permeability increases (i.e., the toner density decreases), the replenishment control unit 405 determines whether the toner was replenished (ACT 614).

If the toner was not replenished (ACT 614: NO), the replenishment control unit 405 drives the toner replenishment motor 252 to replenish toner into the developer storage unit 240 (ACT 615).

Then, the control unit 400 starts the operation of each unit again, such as driving of the developing device motor 241*a* and measuring of the timer (ACT 616), and the process proceeds to ACT 603 of FIG. 6. By proceeding to ACT 603, the output value Vt1 and the output value Vt2 are compared again. Because this second comparison occurs after the first comparison, the output value Vt1 and the output value Vt2 may be considered an example of a third detection value taken at a third timing or third time and a fourth detection value occurring at a fourth timing or a fourth time, respectively, with a second predetermined time period elapsing between the third time and the fourth time. The second predetermined time period may accordingly be equal to the first predetermined time period of the first comparison. The comparison may be used to generate a second comparison value, which is compared to a second threshold value.

On the other hand, if the toner was replenished in ACT 614 (ACT 614: YES), that is, if the comparison in ACT 607 is the second comparison, the notification unit 403 controls the display 110 to issue a notification regarding calibration error 1 (see FIG. 8A) (ACT 617). Further, in ACT 613, if the output value Vt2 is smaller than the output value Vt1 (ACT 613: NO), that is, for example, if the carrier in the developer storage unit 240 is transferred onto the photosensitive drum 21 and the magnetic permeability decreases (i.e., the toner density increases), the notification unit 403 controls the display 110 to issue a notification regarding calibration error 2 (see FIG. 8B) (ACT 618). Thereafter, the determination unit 406 determines that printing is not possible (ACT 619), and the process proceeds to ACT 612 of FIG. 6.

Through the processing described above, the image forming apparatus 100 can calibrate the toner density sensor 243 when the comparison value (e.g., the difference) between the output value Vt1 and the output value Vt2 is less than the threshold value, that is, in a state where the toner density is normal. Therefore, the image forming apparatus 100 can perform printing with an appropriate toner density.

Figure 8A:
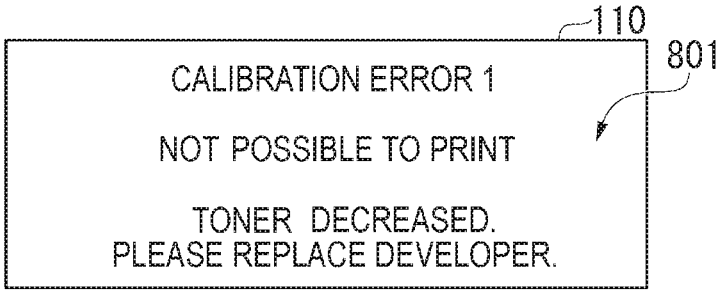
FIGS. 8A to 8D are explanatory diagrams illustrating examples of a screen displayed on a display.

FIGS. 8A to 8D are explanatory diagrams illustrating examples of a screen displayed on the display 110. FIG. 8A illustrates a display screen 801 for the calibration error 1 of the toner density sensor 243. The display screen 801 shows a notification screen indicating the type of error, the fact that printing is not possible, the fact that toner decreases during the stirring operation, and the prompt for developer replacement.

Figure 8B:
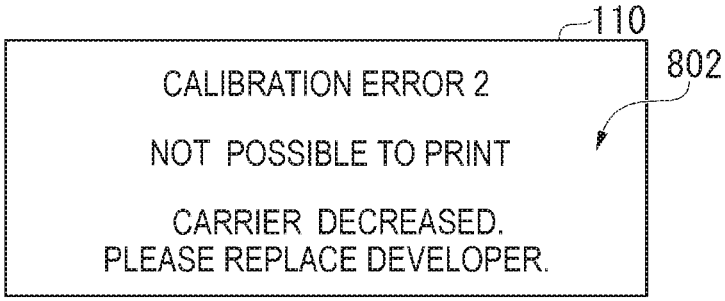

FIG. 8B illustrates a display screen 802 for the calibration error 2 of the toner density sensor 243. The display screen 802 shows a notification screen indicating the type of error, the fact that printing is not possible, the fact that the carrier decreases during the stirring operation, and the prompt for developer replacement.

Figure 8C:
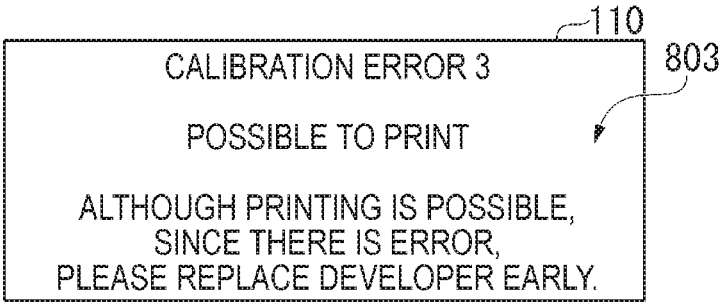

FIG. 8C illustrates a display screen 803 of the calibration error 3 of the toner density sensor 243. The display screen 803 shows a notification screen indicating the type of error, the fact that printing is possible, the fact that an abnormality occurs during the calibration operation, and the prompt for early developer replacement.

Figure 8D:
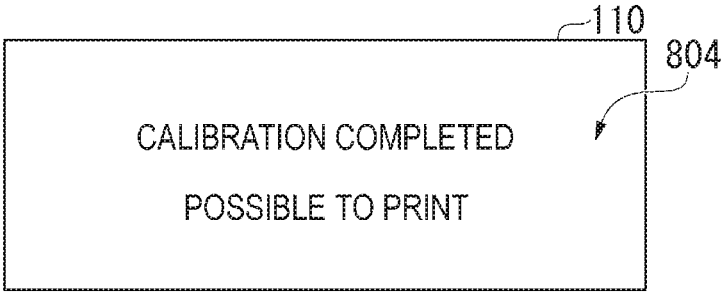

FIG. 8D illustrates a display screen 804 when the calibration of the toner density sensor 243 is normally completed. The display screen 804 shows a notification screen indicating that calibration is completed normally and printing is possible.

By displaying such display screens 801 to 804, the operator can easily grasp whether or not the calibration operation is completed normally, the type of abnormality, whether or not printing is possible, the measures thereafter, and the like.

As described above, the image forming apparatus 100 according to the embodiment issues a notification regarding the suitability of calibration based on the comparison result between the first detection value indicating the toner density at the first timing and the second detection value indicating the toner density at the second timing. As a result, calibration can be performed in a state where the toner density is appropriate. Therefore, since the image forming apparatus 100 can maintain an appropriate toner density, that is, printing can be performed with an appropriate toner density, the deterioration in image quality can be suppressed.

Further, when a comparison result in which the comparison value obtained by comparing the first detection value and the second detection value is less than the threshold value is obtained, the image forming apparatus 100 according to the present embodiment issues a notification regarding that the calibration is appropriate. Therefore, it is possible to issue a notification regarding that the calibration is appropriate when the difference between the first detection value and the second detection value is small. Thereby, an operator such as a service person can easily grasp that the calibration is performed appropriately. On the other hand, the image forming apparatus 100 issues a notification regarding that the calibration is not appropriate when a comparison result in which the comparison value obtained by comparing the first detection value and the second detection value is equal to or greater than the threshold value is obtained. Therefore, it is possible to issue a notification regarding that the calibration is not appropriate when the difference between the first detection value and the second detection value is large. Thereby, an operator such as a service person can easily grasp that the calibration is not performed appropriately.

In addition, the image forming apparatus 100 according to the present embodiment issues different notifications when a comparison result in which the comparison value is equal to or greater than the threshold value is obtained, depending on whether the toner density is decreased or increased during the developer stirring. Accordingly, it is possible to notify the operator of whether an abnormality indicating a decrease in toner density occurs or an abnormality indicating an increase in toner density occurs during the stirring operation. As a result, the operator can grasp the type of abnormality and can take measures according to the type of abnormality.

Further, when a comparison result in which the comparison value is equal to or greater than the threshold value is obtained and the toner density decreases during the developer stirring, the image forming apparatus 100 according to the present embodiment replenishes the developer storage unit 240 with toner, and compares the first detection value and the second detection value again. Therefore, even when a comparison result in which the comparison value is equal to or greater than the threshold value is obtained in the first comparison, the second comparison can be performed. Thereby, when a comparison result in which the comparison value is less than the threshold value is obtained in the second comparison, it is possible to make printing possible and issue a notification regarding that the calibration is performed appropriately. Therefore, when the image forming apparatus 100 is delivered to a customer, since the printing can be made possible for the time being, it is possible to prevent a situation in which the customer cannot use the image forming apparatus 100 after the delivery.

Further, in the image forming apparatus 100 according to the present embodiment, when the toner density decreases during the developer stirring, the developer storage unit 240 is replenished with an amount of toner corresponding to the decrease in toner density. As a result, the image forming apparatus 100 can replenish the amount of toner reduced during the first stirring and compare the first detection value and the second detection value again.

Further, when the comparison result in which the comparison value is less than the threshold value is obtained in the second comparison, the image forming apparatus 100 according to the present embodiment issues a notification regarding that the comparison result in which the comparison value is equal to or greater than the threshold value is obtained in the first comparison (see FIG. 8C). As a result, it is possible to issue a notification regarding that the first calibration is not normal although the second calibration is normal. Therefore, the operator can be notified of the type of abnormality in more detail.

In addition, the image forming apparatus 100 according to the present embodiment determines that printing is not possible when a comparison result in which the comparison value is equal to or greater than the threshold value is obtained in the second comparison. Here, it is assumed that the same comparison result can be obtained even if the second comparison is performed twice or more. For this reason, it is possible to make printing impossible by performing the second comparison only once. Therefore, it is possible to quickly determine whether or not printing is possible.

In addition, the image forming apparatus 100 according to the present embodiment determines that printing is possible when a comparison result in which the comparison value is less than the threshold value is obtained in the second comparison. As a result, when the image forming apparatus 100 is delivered to a customer, since the printing can be made possible for the time being, it is possible to prevent a situation in which the customer cannot use the image forming apparatus 100 after the delivery.

Further, when a comparison result in which the comparison value is equal to or greater than the threshold value is obtained and it is determined that the toner density increases during the developer stirring, the image forming apparatus 100 according to the present embodiment determines that printing is not possible. As a result, when the carrier in the developer storage unit 240 decreases, since the carrier cannot be replenished, printing cannot be performed immediately. Therefore, it is possible to quickly determine whether or not printing is possible, and it is possible to prevent printing when there is a possibility of image failure.

In the image forming apparatus 100 according to the present embodiment, the comparison value is a value based on the difference between the first detection value and the second detection value. Thereby, a comparison value can be obtained by a simple calculation process. Therefore, it is possible to reduce the load related to the process of issuing a notification regarding the suitability of calibration.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a developer container configured to contain a two-component developer including a toner and a carrier;

an agitator configured to stir the two-component developer;

a toner supply configured to replenish the developer container with additional toner;

a toner sensor configured to detect a toner density of the two-component developer in the developer container; and a controller configured to:

calibrate the toner sensor using the two-component developer;

obtain a comparison value by comparing a first detection value of the toner sensor indicating a toner density at a first time with a second detection value of the toner sensor indicating a toner density at a second time after a predetermined time period has elapsed since the first time;

determine whether or not the comparison value is equal to or greater than a threshold value; and in response to a determination that the comparison value is equal to or greater than the threshold value, both:

determine whether the toner density decreased or increased from the first time to the second time; and issue a notification indicating that the calibration is not appropriate, the notification varying depending on whether the controller determines that the toner density decreased or increased from the first time to the second time.

2. The image forming apparatus of claim 1, wherein the controller is configured to:

control the toner supply to replenish the developer container with additional toner in response to a determination that the toner density decreased from the first time to the second time.

3. The image forming apparatus of claim 2, wherein the toner supply is configured to replenish the developer container with an amount of additional toner corresponding to a magnitude of the decrease in toner density from the first time to the second time.

4. The image forming apparatus of claim 2, wherein the predetermined time period is a first predetermined time period and the controller is configured to:

after controlling the toner supply to replenish the developer container with additional toner, compare a third detection value of the toner sensor indicating a toner density at a third time with a fourth detection value of the toner sensor indicating a toner density at a fourth time after a second predetermined time period has elapsed since the third time.

5. The image formatting apparatus of claim 4, wherein the first predetermined time period is equal to the second predetermined time period.

6. The image forming apparatus of claim 4, wherein:

the comparison value is a first comparison value and the threshold value is a first threshold value;

the controller is configured to determine whether or not a second comparison value obtained by comparing the third detection value and the fourth detection value is equal to or greater than a second threshold value; and the notification indicates that the first comparison value is equal to or greater than the first threshold value in response to a determination that the second comparison value is less than the second threshold value.

7. The image forming apparatus of claim 4, wherein the comparison value is a first comparison value, the threshold value is a first threshold value, and the controller is configured to:

determine whether or not a second comparison value obtained by comparing the third detection value and the fourth detection value is equal to or greater than a second threshold value; and prevent printing in response to a determination that the second comparison value is equal to or greater than the second threshold value.

8. The image forming apparatus of claim 7, wherein the controller is configured to:

determine that printing is possible in response to a determination that the second comparison value is less than the second threshold value.

9. An image forming apparatus comprising:

a developer container configured to contain a two-component developer including a toner and a carrier;

an agitator configured to stir the two-component developer;

a toner supply configured to replenish the developer container with additional toner;

a toner sensor configured to detect a toner density of the two-component developer in the developer container; and a controller configured to:

calibrate the toner sensor using the two-component developer;

obtain a comparison value by comparing a first detection value of the toner sensor indicating a toner density at a first time with a second detection value of the toner sensor indicating a toner density at a second time after a predetermined time period has elapsed since the first time;

determine whether the comparison value is equal to or greater than a threshold value;

issue a notification indicating that the calibration is not appropriate in response to a determination that the comparison value is equal to or greater than the threshold value;

determine whether or not the toner density increased from the first time to the second time in response to the determination that the comparison value is equal to or greater than the threshold value; and prevent printing in response to a determination that the toner density increased from the first time to the second time.

10. An image forming apparatus comprising:

a developer container configured to contain a two-component developer including a toner and a carrier;

an agitator configured to stir the two-component developer;

a toner supply configured to replenish the developer container with additional toner;

a toner sensor configured to detect a toner density of the two-component developer in the developer container; and a controller configured to:

calibrate the toner sensor using the two-component developer;

obtain a comparison value based on a difference between a first detection value of the toner sensor indicating a toner density at a first time and a second detection value of the toner sensor indicating a toner density at a second time after a predetermined time period has elapsed since the first time;

determine whether the comparison value is equal to or greater than a threshold value; and issue a notification indicating that the calibration is not appropriate in response to a determination that the comparison value is equal to or greater than the threshold value.

11. An image forming apparatus comprising:

a developer container configured to contain a two-component developer including a toner and a carrier;

an agitator configured to stir the two-component developer;

a toner supply configured to replenish the developer container with additional toner;

a toner sensor configured to detect a toner density of the two-component developer in the developer container; and a controller configured to:

calibrate the toner sensor using the two-component developer by adjusting a control input voltage of the toner sensor until an output value of the toner sensor is within a target value range;

compare a first detection value of the toner sensor indicating a toner density at a first time with a second detection value of the toner sensor indicating a toner density at a second time after a predetermined time period has elapsed since the first time; and issue a notification regarding a suitability of calibration based on a comparison result of the comparison of the first detection value with the second detection value.

12. An image forming apparatus comprising:

a developer container configured to contain a two-component developer including a toner and a carrier;

an agitator configured to stir the two-component developer;

a toner supply configured to replenish the developer container with additional toner;

a toner sensor configured to detect a toner density of the two-component developer in the developer container; and a controller configured to:

calibrate the toner sensor using the two-component developer;

compare a first detection value of the toner sensor indicating a toner density at a first time with a second detection value of the toner sensor indicating a toner density at a second time after a predetermined time period has elapsed since the first time;

issue a notification regarding a suitability of calibration based on a comparison result of the comparison of the first detection value with the second detection value; and control the agitator to stir the two-part developer throughout the first predetermined time period from the first time to the second time.

13. The image forming apparatus of claim 12, wherein the agitator includes a stirring roller extending within the developer container.

14. A notification method to be performed by an image forming apparatus, the method comprising:

stirring a two-component developer in a developer container containing the two-component developer, the two-component developer including a toner and a carrier;

detecting, by a toner sensor, a toner density of the two-component developer in the developer container;

calibrating the toner sensor using the two-component developer;

determining a first detection value using the toner sensor, the first detection value indicating a toner density at a first time;

determining a second detection value using the toner sensor, the second detection value indicating a toner density at a second time after a predetermined time period has elapsed since the first time;

determining a comparison value based on a comparison of the first detection value with the second detection value;

determining whether or not the comparison value is equal to or greater than a threshold value;

issuing a notification indicating that the calibration is not appropriate in response to a determination that the comparison value is equal to or greater than the threshold value;

determining whether or not the toner density decreased from the first time to the second time in response to a determination that the comparison value is equal to or greater than the threshold value; and replenishing the developer container with additional toner in response to a determination that the toner density decreased from the first time to the second time.

15. The notification method of claim 14, wherein the predetermined time period is a first predetermined time period, the comparison value is a first comparison value, and the threshold value is a first threshold value, further comprising:

determining a third detection value using the toner sensor, the third detection value indicating a toner density at a third time;

determining a fourth detection value using the toner sensor, the fourth detection value indicating a toner density at a fourth time after a second predetermined time period has elapsed since the third time, and both the third time and the fourth time occurring after replenishing the developer container with additional toner;

determining a second comparison value based on a comparison of the third detection value with the fourth detection value; and determining whether or not the second comparison value is equal to or greater than a second threshold value, wherein the notification indicates that the first comparison value is equal to or greater than the first threshold value in response to a determination that the second comparison value is less than the second threshold value.

16. A notification method to be performed by an image forming apparatus, the method comprising:

stirring a two-component developer in a developer container containing the two-component developer, the two-component developer including a toner and a carrier;

detecting, by a toner sensor, a toner density of the two-component developer in the developer container;

calibrating the toner sensor using the two-component developer;

determining a first detection value using the toner sensor, the first detection value indicating a toner density at a first time;

determining a second detection value using the toner sensor, the second detection value indicating a toner density at a second time after a first predetermined time period has elapsed since the first time;

determining a comparison value based on a comparison of the first detection value with the second detection value;

determining whether or not the first comparison value is equal to or greater than a threshold value;

issuing a notification indicating that the calibration is not appropriate in response to a determination that the comparison value is equal to or greater than the threshold value;

determining whether or not the toner density increased from the first time to the second time in response to the determination that the comparison value is equal to or greater than the threshold value; and preventing printing in response to a determination that the toner density increased from the first time to the second time.

* * * * *